US006371176B1

(12) United States Patent
Burr et al.

(10) Patent No.: US 6,371,176 B1
(45) Date of Patent: Apr. 16, 2002

(54) LOG SIDING PLANER SHAPER

(76) Inventors: Milton E. Burr, HC 7, Box 108, Aitkin, MN (US) 56431; Jon H. Gillette, Rte. 1, Box 70, Tamarack, MN (US) 55787; Laverne M. Watters, Rte. 2, Box 629, Aitkin, MN (US) 56431

( * ) Notice: Subject to any disclaimer, the term of this patent is extended or adjusted under 35 U.S.C. 154(b) by 0 days.

(21) Appl. No.: 09/606,797

(22) Filed: Jun. 29, 2000

(51) Int. Cl.[7] ..... B27M 1/08; B27C 9/00

(52) U.S. Cl. ..... 144/3.1; 144/24.05; 144/116; 144/135.3; 144/369; 144/248.3; 144/248.6

(58) Field of Search ..... 144/2.1, 3.1, 4.3, 144/24.05, 114, 116, 117.2, 134.1, 135.3, 135.4, 137, 142, 367, 369, 248.3, 248.4, 248.5, 248.6, 242.1, 133.1

(56) References Cited

U.S. PATENT DOCUMENTS

| | | | | | |
|---|---|---|---|---|---|
| 2,170,687 | A | * | 8/1939 | Johnson | 144/135.3 |
| 3,326,252 | A | * | 6/1967 | Pease | 144/3.1 |
| 3,756,295 | A | * | 9/1973 | Halop | 144/3.1 |
| 3,799,224 | A | * | 3/1974 | Vizziello et al. | 144/135.3 |
| 4,077,448 | A | * | 3/1978 | Hasenwinkle et al. | 144/24.05 |

* cited by examiner

*Primary Examiner*—W Donald Bray
(74) *Attorney, Agent, or Firm*—Gary L. Huusko

(57) ABSTRACT

This invention relates to a planing machine that can plane and shape a workpiece to replicate a hand-hewn log for use in siding, paneling and other similar type building needs.

6 Claims, 4 Drawing Sheets

LOG SIDING PLANER SHAPER

BACKGROUND—FIELD OF INVENTION

This invention relates to a log siding planer shaper. More particularly, this invention relates to a planer that shapes log siding for the exterior or interior of buildings.

BACKGROUND—DESCRIPTION OF PRIOR ART

There are many varieties of power tools that are used in woodworking to cut workpieces to desired dimensions and surface quality. As is widely known, planing machines are often used for surface planing of wood boards. A conventional planing machine typically includes one or more rotatable mounted cutting blades attached to a vertically movable carriage assembly.

In a typical wood planing machine, such as a surface planer, an adjustable workpiece opening is defined between a carriage assembly and a support surface. The one or more rotationally mounted blades are carried on the underside of the carriage assembly adjacent to the workpiece opening. The blades are adapted to remove a predetermined amount of material from the workpiece depending on the height of the adjustable workpiece opening. The carriage assembly also usually includes one or more feed rollers that urge the workpiece through the workpiece opening during operation of the wood planing machine.

In most applications, the carriage assembly of a wood planing machine is movably mounted to a plurality of support columns for movement with respect to a workpiece support surface, such as a base. Such movement of carriage assembly adjusts the vertical dimension of the workpiece opening so as to selectively determine the amount of material to be removed from the workppiece. Alternatively, in certain applications it is desirable to fixedly mount the carriage assembly and to adjust the workpiece opening by moving the base vertically with respect to the carriage assembly.

In use, a workpiece is passed through the workpiece opening and a predetermined amount of material is removed from the surface of the workpiece adjacent the carriage assembly. Multiple passes of the workpiece through the workpiece opening are often necessary to obtain the desired thickness and surface quality. As with other woodworking operations, it is desirable that a planing machine accomplish workpiece preparation with precise tolerances, high surface quality, and a significant degree of reproducible results. In a typical wood planing machine, it is important that the carriage assembly remain vertically fixed with respect to the support base when the workpiece is passed through the workpiece opening. Slight movement of the carriage assembly negatively impacts the quality of the cut.

With the increased popularity of log homes, or siding that replicates the look of a log home, there exists a need to allow for uneven, yet high quality cutting by a wood planing type machine. It is thus desirable to provide a controlled movement of the rotationally mounted blades to replicate a hand-hewn log. It is also desirable to provide for a controlled movement of the base or table-top upon which the workpiece will rest as it passes through the planer.

There is no product similar to or the same as the present invention, which provides log-like look to a wood workpiece to be used as siding, paneling or other similar type use.

OBJECTS AND ADVANTAGES

It is an object of the present invention to provide a wood-working tool for planing and shaping of a surface of a workpiece to replicate the surface of a hand-hewn log.

It is also an object of the present invention to provide a cam controlled pivotably attached rotating cutting member to cut, plane and shape the surface of the workpiece so as to replicate a hand-hewn log.

It is a further object of the present invention to provide adjustable stops and spring-loaded braces to limit depth of the cutting and shaping of the surface of the workpiece.

It is still a further object of the present invention to provide a pivotally attached rocking table top so as to provide a random yet accurate shaping of the surface of the workpiece so as to replicate a natural looking hand-hewn log.

Still other objects and advantages of this invention will become apparent from a consideration of the ensuing description and drawings.

DRAWING FIGURES

FIG. 1 shows a side view of the log siding planer shaper, including a plurality of rotating cutting members and a plurality of irregularly shaped cam disks used to control the cutting depth of the rotating cutting members, wherein the workpiece is introduced from the left-hand side of the drawing and proceeds through the machine, exiting at the right side of the drawing.

FIG. 2 shows an overhead view of the machine, again with the workpiece being introduced from the left side of the drawing and proceeding to the right side of the drawing.

FIG. 3 shows an exploded perspective view of a section of the machine showing one of the pivotably attached rotating cutting members, one of the irregularly shaped cam disks and an adjustable stop and a spring-loaded brace to limit the depth of the cut.

FIG. 4 shows the pivotally attached table top base upon which the workpiece will travel through the machine.

Figure 1:
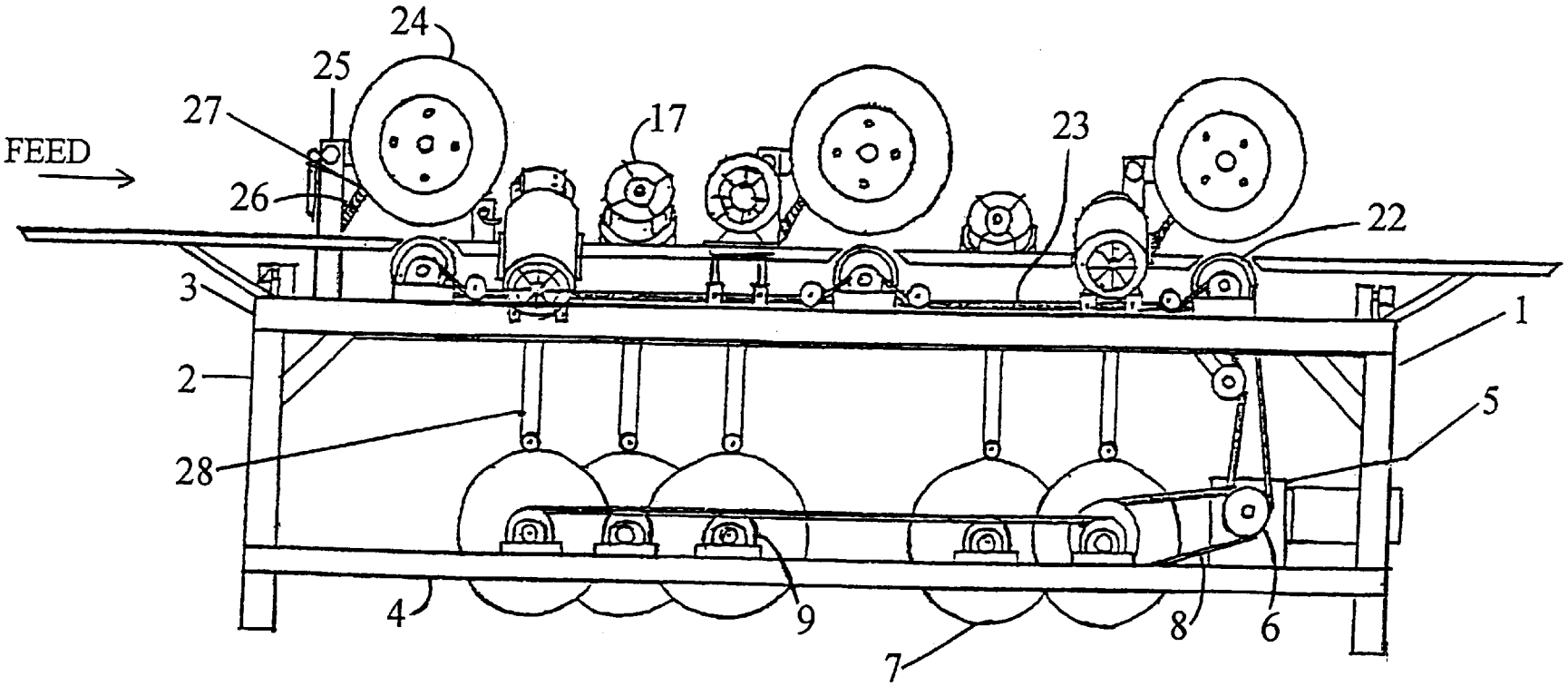
FIG. 1 shows a side view of the planer shaper machine. The carriage assembly 1 is comprised of a plurality of lower support members 2 or legs and a support surface 3. A base 4 is fixedly attached to the lower support members 2.

A motor 5, comprising a plurality of motor gears 6, is fixedly attached to the base 4 of the carriage assembly 1. The motor 5 thereby provides power through the motor gears 6 to a plurality of irregularly shaped cam disks 7 by means of a system of first drive chains 8 and first gears 9, the first gears 9 being fixedly attached to the irregularly shaped cam disks 7. A system of belts and pulleys could also be used in place of the system of the first drive chains 8 and first gears 9. The irregularly shaped cam disks 7 are rotatably attached to the base 4.

Figure 2:
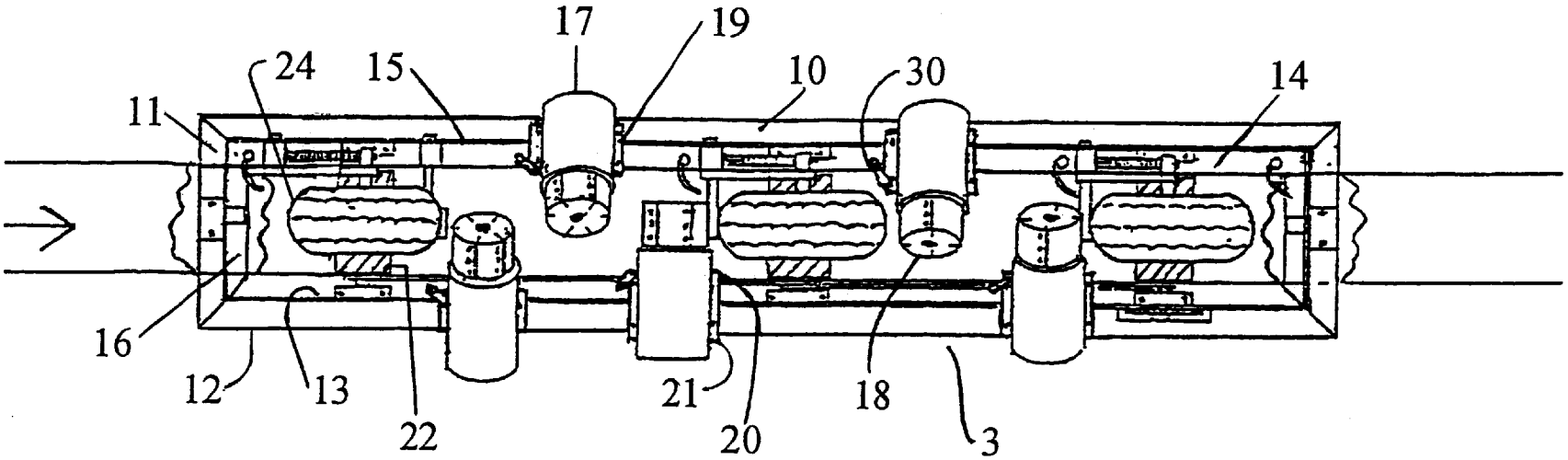

Referring now to FIG. 2, which shows a top view of the planer shaper. The support surface 3 is comprised of two side support members 10 and two end support members 11, the side support members 10 being rigidly attached to the end support members 11, thereby forming a rectangular surface having an outer perimeter 12 and an inner perimeter 13. A rocking tabletop 14, having two inner side members 15 rigidly attached to two inner end members 16, is pivotally attached at each inner end member 16 to each end support member 11 of the support surface 3. A plurality of cutting members 17 are pivotally attached to the side support members 10 of the support surface 3. The cutting members 17 are comprised of a cutting blade 18 and a cutting member base 19, said cutting member base 19 having a forward edge 20 and a rearward edge 21.

Referring again to FIG. 1, a plurality of cylindrical drive pulleys 22 are rigidly attached to the rocking tabletop 14. The cylindrical drive pulleys 22 are driven by means of a second drive chain 23 attached to the motor 5 and thus can pull the workpiece through the machine for cutting. A drive belt could be used as well as the second drive chain 23. Optimally the drive pulleys 22 have a frictional cylindrical surface such as rubber to maintain contact with the workpiece, however other materials known in the field will work equally as well. The preferred embodiment of the drive pulley 22 shows a plurality of metal cross-member pieces rigidly attached to the drive pulley 22 in the configuration of a double herringbone. A plurality of guide wheels 24 are slidably attached to a plurality of upper support members 25 that are rigidly attached to one of the side support members 10 of the support surface 3 so that the respective guide wheels 24 press on the workpiece as the workpiece is pulled through the machine by the drive pulleys 22. In the drawings as shown, a spring 26 is disposed about a slide arm 27 to provide resistance, thereby holding the guide wheel 24 down onto the surface of the workpiece, although a weighted guide wheel using gravity could work equally as well. Each guide wheel 24 is disposed directly above each respective drive pulley 22 whereby the guide wheel 24 applies an even pressure to the workpiece so that the workpiece stays in contact with the drive pulley 22.

Still referring to FIG. 1, as the workpiece progresses through the machine it encounters the cutting blade 18 of the rotatable cutting member 17 that then cuts away a portion of the surface of the workpiece. The cutting member 17 is pivotally attached at the rearward edge 21 to one of the side support members 10 of the support surface 3 so as to allow the cutting member 17 to move up and down.

Figure 3:
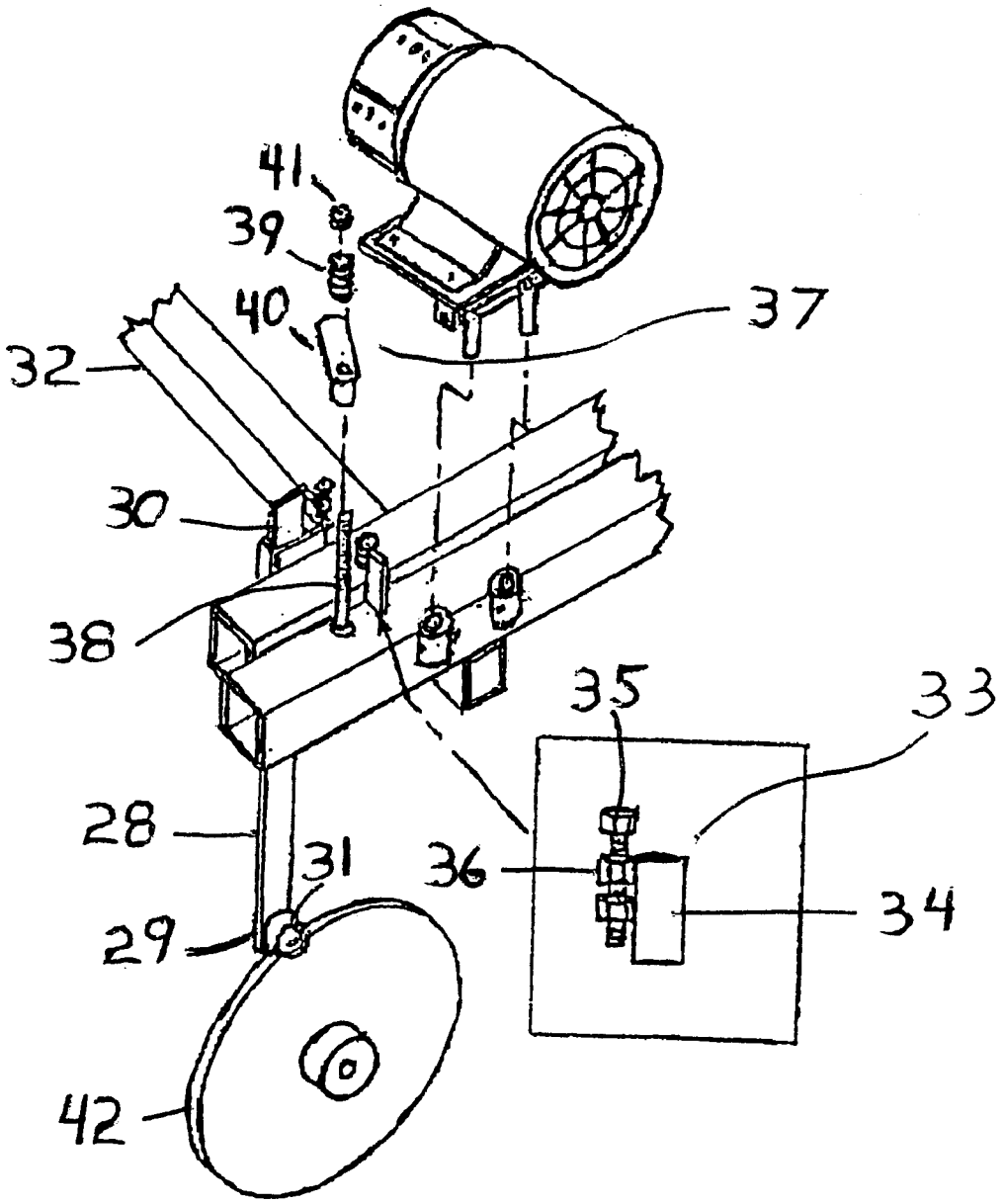

The movement of the cutting member 17 is controlled by two means, both shown in FIG. 3. FIG. 3 shows a piston arm 28 having a lower end 29 and an upper end 30. The lower end 29 of the piston arm 28 has a rotatably attached wheel 31 resting on the irregularly shaped cam disk 7. The upper end 30 of the piston arm 28 is slidably attached to a cross-member support beam 32 which is rigidly attached to the side support member 10 of the support surface 3. A plurality of cross-member support beams 32 are so attached for all but one of the piston arms 28. The piston arm 28 moves up and down as the irregularly shaped cam disk 7 rotates, thereby moving the cutting blade 18 of the cutting member 17 up and down. The irregularly shaped cam disk 7 rotates by means of the first drive chain 8 that is attached to the motor 5 and the irregularly shaped cam disk 7. As shown, the irregularly shaped cam disk 7 is disposed directly below the cutting member 17 to allow the piston arm 28 to operate efficiently.

Still referring to FIG. 3, the second means by which the cutting member 17 is controlled is by an adjustable stop 33. The adjustable stop 33 is comprised of a stop plate 34, a first bolt 35 and one or more first nuts 36. The stop plate 34 is rigidly attached to the side support member 10 of the support surface 3. The first nuts 36 are rigidly attached to the stop plate 34, thereby allowing the first bolt 35 to be adjusted up or down by screwing the first bolt 35 into the first nuts 36. The adjustable stop 33 is located directly below the forward edge 20 of the cutting member base 19 of the cutting member 17 so that the cutting member 17 can only go down a limited distance before it hits the adjustable stop 33. In this way, the depth of the cut is controlled, A spring-loaded brace 37 is fixedly attached to the side support member 10 of the support surface 3 by means of a second bolt 38. The spring-loaded brace 37 comprises a spring 39, a brace arm 40 and a second nut 41. The brace arm 40 rests on the forward edge 20 of the cutting member base 19 and is forced downward by the action of the spring 39, thereby limiting the upward movement of the cutting member 17 and keeping the cutting member 17 in contact with the workpiece. The shape of the irregularly shaped cam disks 7 are imperfectly shaped circles, made by removing a little of the material from a irregularly shaped car disks edge 42, thereby allowing random movement of the piston arm 29.

Figure 4:
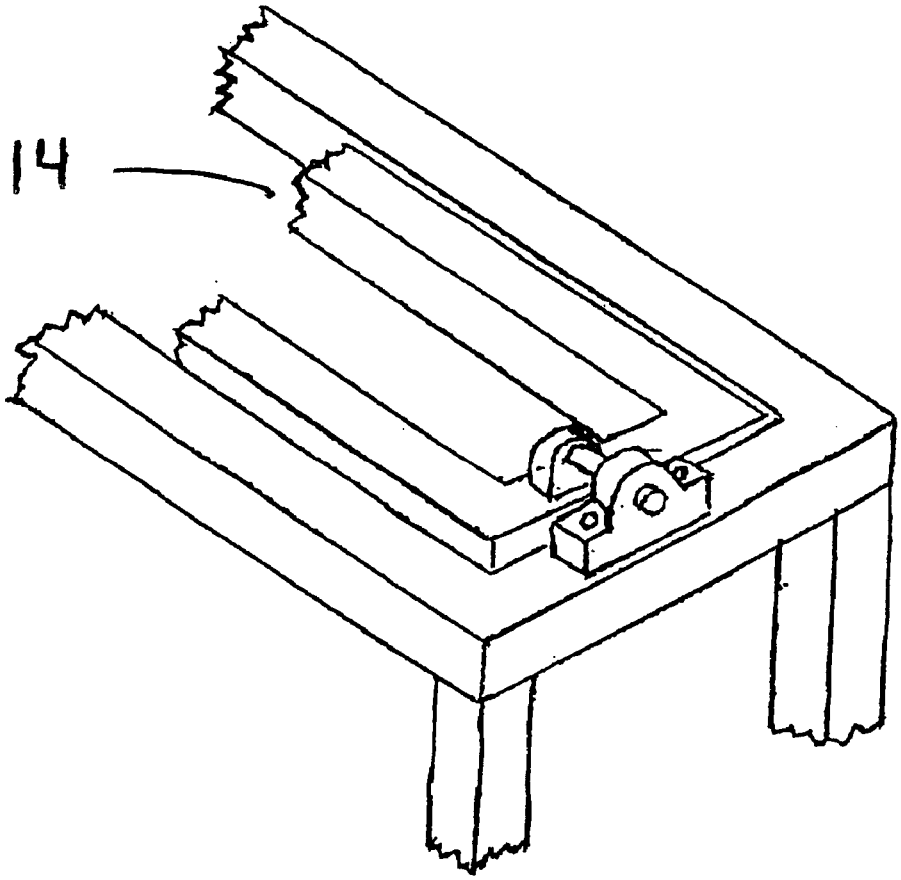

FIG. 4 shows the rocking table top 14 which includes the two inner side members 15 and the two inner end members 16 and is disposed within the inner perimeter 13 of the support surface 3. The inner end members 16 of the rocking table top are pivotally attached to the inner perimeter 13 of the end support members 11 of the support surface 3, thus allowing the rocking table top 14 to tilt one way and then the other. Rocking motion of the rocking table top 14 is accomplished by rigidly attaching one of the piston arms 28 to the inner side member 15 of the rocking table top 14.

Referring once again to FIG. 1, as the workpiece progresses through the machine, the drive pulley 22 and guide wheel 24 pull and guide the workpiece through the machine. The irregularly shaped cam disk 7 rotates, moving the piston arm 28 up and down, thereby moving the cutting member 17 up and down to effectuate a cut that replicates a hand-hewn log. The adjustable stop 33 prevents an excessive amount of material from being removed form the workpiece.

In the drawings as shown in FIGS. 1 and 2, the plurality of drive pulleys 22, guide wheels 24, cutting members 17, irregularly shaped cam disks 7, piston arms 28, and adjustable stops 33 are shown, thereby allowing long workpieces to be planed and shaped. Necessarily, a plurality of upper support members 25 would also be required to accommodate the plurality of guide wheels 24. The present invention could be expanded to an even greater number of each such element or member to accommodate even longer or larger workpieces.

As can be seen from the drawings, this invention provides for an efficient and economical way to plane and shape workpieces in a random manner so as to replicate natural hand-hewn logs for use in the interiors and exteriors of buildings, and the like.

SUMMARY

Accordingly, the reader will see that this invention provides a more efficient way to manufacture siding with a hand-hewn log look than by actually hewing the logs by hand. In addition, this invention provides for the mass production of siding and paneling and the like of hand-hewn log.

Although the description above contains many specificities, these should not be construed as limiting the scope of the invention but as merely providing illustrations of some of the preferred embodiments of this invention. For example, materials other than wood may be used as workpieces, depending upon the capabilities of the cutting blades, and uses of the hand-hewn log look product may be used in more ways than merely as siding or paneling.

Thus the scope of the invention should be determined by the appended claims and their legal equivalents, rather than by the examples given.

What is claimed is:

1. A planing machine for planing and shaping a surface of a workpiece, the planing machine comprising:

a motor fixedly attached to a carriage assembly said carriage assembly comprising a plurality of lower support members rigidly attached to a rectangular shaped support surface comprising two side support members and two end support members, said side support members being rigidly attached to said end support members thereby forming said support surface having an outer perimeter and an inner perimeter;

a base fixedly attached to said lower support members;

a cross-member support beam fixedly attached to said base;

an upper support member rigidly attached to one of said side support members of said support surface;

a rotatable cutting member comprised of a cutting blade and a cutting member base and adapted for cutting a surface of the workpiece, said rotatable cutting member being pivotally attached to one of said side support members of said support surface so as to allow movement up and down;

a rocking table top comprising two inner sides and two inner ends and disposed within said inner perimeter of said support surface, said inner ends of said rocking table top pivotably attached to said inner perimeter of said end support members of said support surface;

a cylindrical drive pulley fixedly attached to said side support members to pull the workpiece through the planing machine;

a rotatable guide wheel pivotably attached to said upper support member and disposed directly above said drive pulley whereby said guide wheel applies pressure to the workpiece;

an irregularly shaped cam disk rotatably attached to said base and disposed directly below said cutting member;

a piston arm member comprising a lower end and an upper end, said lower end having a rotatably attached wheel resting on said irregularly shaped cam disk and said upper end being slidably attached to said carriage assembly thereby being disposed beneath the cutting member;

an adjustable stop attached to said support surface and disposed directly below said cutting member wherein said cutting member rests upon said adjustable stop, thereby limiting the depth of the cut by said cutting member;

a spring-loaded brace comprising a second bolt, a brace arm slideably attached to said second bolt, a spring disposed about said second bolt and above said brace arm, and a second nut threadably attached to said second bolt such that said spring forces said brace arm away from said second nut, said spring loaded brace being fixedly attached to said side support member such that said brace arm is disposed above said cutting member base, thereby exerting a downward force on said cutting member base;

a first drive chain connecting said motor to said irregularly shaped cam disk;

a second drive chain connecting said motor to said drive pulley;

whereby the workpiece is pulled through the machine by said drive pulley and is held to said rocking table top by said guide wheel and is cut in a predetermined pattern by the up and down movement of said cutting member as controlled by the rotation of said irregularly shaped cam disk and movement of said piston arm.

2. The planing machine of claim 1 further comprising:

a plurality of upper support members, a plurality of cross-member support beams, a plurality of rotatable cutting members, a plurality of cylindrical drive pulleys, a plurality of rotatable guide wheels, a plurality of irregularly shaped cam disks, a plurality of piston arm members, a plurality of wheels, a plurality of adjustable stops, and a plurality of spring-loaded braces.

3. The planing machine of claim 2 wherein said upper end of one of said piston arms is fixedly attached to one of said inner sides of said rocking table top thereby controlling movement of said rocking table top.

4. The planing machine of claim 3 wherein the plurality of upper support members is limited to three, wherein the plurality of rotatable cutting members is limited to five, wherein the plurality of cylindrical drive pulleys is limited to three, wherein the plurality of rotatable guide pulleys is limited to three, wherein the plurality of irregularly shaped cam disks is limited to five, wherein the plurality of piston arm members is limited to five, wherein the plurality of adjustable stops is limited to five, and wherein the plurality of spring-loaded braces is limited to five.

5. The planing machine of claim 4 wherein two of said five cutting members are attached to one of said side support members of said support surface and the other three cutting members are attached to the other side support member of said support surface.

6. The planing machine of claim 5 wherein said first drive chain is a drive belt and said second drive chain is a drive belt.

* * * * *